US007055327B1

(12) United States Patent
Pekrul et al.

(10) Patent No.: US 7,055,327 B1
(45) Date of Patent: Jun. 6, 2006

(54) PLASMA-VORTEX ENGINE AND METHOD OF OPERATION THEREFOR

(75) Inventors: Merton W. Pekrul, Mesa, AZ (US); Enrique de Vilmorin, Chula Vista, CA (US)

(73) Assignee: Fibonacci Anstalt, Vaduz (LI)

( * ) Notice: Subject to any disclaimer, the term of this patent is extended or adjusted under 35 U.S.C. 154(b) by 0 days.

(21) Appl. No.: 11/077,289

(22) Filed: Mar. 9, 2005

(51) Int. Cl.
*F01K 25/08* (2006.01)

(52) U.S. Cl. ..... 60/651; 60/671

(58) Field of Classification Search ..... 60/645, 60/651, 670, 671
See application file for complete search history.

(56) References Cited

U.S. PATENT DOCUMENTS

| | | | | |
|---|---|---|---|---|
| 122,713 | A | 1/1872 | Faucett | |
| 4,115,045 | A | 9/1978 | Wyman | |
| 5,039,290 | A | 8/1991 | Nardi | |
| 5,359,966 | A * | 11/1994 | Jensen | 122/17.1 |
| 5,501,586 | A | 3/1996 | Edwards | |
| 5,755,196 | A | 5/1998 | Klassen | |
| 5,758,501 | A | 6/1998 | Jirnov et al. | |
| 5,946,916 | A | 9/1999 | Ven et al. | |
| 5,968,378 | A * | 10/1999 | Jensen | 219/121.43 |
| 6,036,463 | A | 3/2000 | Klassen | |
| 6,164,263 | A | 12/2000 | Saint-Hilaire et al. | |
| 6,169,852 | B1 | 1/2001 | Liao et al. | |
| 6,354,262 | B1 | 3/2002 | Wade | |
| 6,530,211 | B1 | 3/2003 | Holtzapple et al. | |
| 6,565,310 | B1 | 5/2003 | Davidow | |
| 6,594,997 | B1 | 7/2003 | Romanelli | |
| 6,601,570 | B1 * | 8/2003 | Zetmeir | 123/536 |
| 6,659,067 | B1 | 12/2003 | Al-Hawaj | |
| 6,684,847 | B1 | 2/2004 | Al-Hawaj | |
| 6,722,182 | B1 | 4/2004 | Buettner | |
| 6,729,296 | B1 * | 5/2004 | King | 123/243 |
| 6,739,852 | B1 | 5/2004 | Klassen | |
| 6,772,728 | B1 | 8/2004 | Al-Hawaj | |
| 6,773,226 | B1 | 8/2004 | Al-Hawaj | |

* cited by examiner

*Primary Examiner*—Hoang Nguyen

(57) ABSTRACT

A plasma-vortex engine (20), consisting of a plasmatic fluid (22) circulating in a closed loop (44) encompassing a fluid heater (26), an expansion chamber (30), and a condenser (42), is provided. The expansion chamber (30) is formed of a housing (64) and two end plates (66, 68), and encompasses a rotor (72) to which a plurality of vanes (74) is coupled. A shaft (36) is coupled to the rotor (72) through the endplates (66, 68). During operation, the fluid heater (26) heats the plasmatic fluid (22) to produce a plasma (86), which is then injected into the expansion chamber (30). The plasma (86) expands both hydraulically and adiabatically and exerts an expansive force (94) against one of the vanes (74). A vortex generator (96) coupled to the expansion chamber generates a vortex (100) within the plasma (86), which exerts a vortical force (102) against that one vane (74). The rotor (72) and shaft (36) rotate in response to the expansive and vortical forces (94, 102). The plasma (86) is exhausted from the expansion chamber (30) and is condensed back into the plasmatic fluid (22) by the condenser (42).

23 Claims, 9 Drawing Sheets

PLASMA-VORTEX ENGINE AND METHOD OF OPERATION THEREFOR

TECHNICAL FIELD OF THE INVENTION

The present invention relates to the field of rotary engines. More specifically, the present invention relates to the field of external-combustion rotary engines.

BACKGROUND OF THE INVENTION

The controlled expansion of gases forms the basis for the majority of non-electrical rotational engines in use today. These engines include reciprocating, rotary, and turbine engines, and may be driven by heat (heat engines) or other forms of energy. Heat engines may use combustion, solar, geothermal, nuclear, or other forms of thermal energy. Combustion-based heat engines may utilize either internal or external combustion.

Internal-combustion engines derive power from the combustion of a fuel within the engine itself. Typical internal-combustion engines include reciprocating engines, rotary engines, and turbine engines.

Internal-combustion reciprocating engines convert the expansion of burning gases (typically, an air-fuel mixture) into the linear movement of pistons within cylinders. This linear movement is then converted into rotational movement through connecting rods and a crankshaft. Examples of internal-combustion reciprocating engines are the common automotive gasoline and diesel engines.

Internal-combustion rotary engines use rotors and chambers to more directly convert the expansion of burning gases into rotational movement. An example of an internal-combustion rotary engine is the Wankel engine, which utilizes a triangular rotor that revolves in a chamber, instead of pistons within cylinders. The Wankel engine has fewer moving parts and is generally smaller and lighter, for a given power output, than an equivalent internal-combustion reciprocating engine.

Internal-combustion turbine engines direct the expansion of burning gases against a turbine, which then rotates. An example of an internal-combustion turbine engine is a turboprop aircraft engine, in which the turbine is coupled to a propeller to provide motive power for the aircraft.

Internal-combustion turbine engines are often used as thrust engines, where the expansion of the burning gases exit the engine in a controlled manner to produce thrust. An example of an internal-combustion turbine/thrust engine is the turbofan aircraft engine, in which the rotation of the turbine is typically coupled back to a compressor, which increases the pressure of the air in the air-fuel mixture and markedly increases the resultant thrust.

All internal-combustion engines of this type suffer from poor efficiency. Only a small percentage of the potential energy is released during combustion, i.e., the combustion is invariably incomplete. Of that energy released in combustion, only a small percentage is converted into rotational energy. The rest must be dissipated as heat.

If the fuel used is a typical hydrocarbon or hydrocarbon-based compound (e.g., gasoline, diesel oil, or jet fuel), then the partial combustion characteristic of internal-combustion engines causes the release of a plethora of combustion by-products into the atmosphere in the form of an exhaust. In order to reduce the quantity of pollutants, a support system consisting of a catalytic converter and other apparatuses is often necessitated. Even when minimized, a significant quantity of pollutants is released into the atmosphere as a result of incomplete combustion.

Because internal-combustion engines depend upon the rapid (i.e., explosive) combustion of fuel within the engine itself, the engine must be engineered to withstand a considerable amount of pressure and heat. These are drawbacks that require a more robust and more complex engine over external-combustion engines of similar power output.

External-combustion engines derive power from the combustion of a fuel in a combustion chamber separate from the engine. A Rankine-cycle engine typifies a modern external-combustion engine. In a Rankine-cycle engine, fuel is burned in the combustion chamber and used to heat a liquid at a substantially constant pressure. The liquid is vaporized to become the desired gas. This gas is passed into the engine, where it expands. The desired rotational power is derived from this expansion. Typical external-combustion engines also include reciprocating engines, rotary engines, and turbine engines.

External-combustion reciprocating engines convert the expansion of heated gases into the linear movement of pistons within cylinders. This linear movement is then converted into rotational movement through linkages. The conventional steam locomotive engine is an example of an external-combustion open-loop Rankine-cycle reciprocating engine. Fuel (wood, coal, or oil) is burned in a combustion chamber (the firebox) and used to heat water at a substantially constant pressure. The water is vaporized to become the desired gas (steam). This gas is passed into the cylinders, where it expands to drive the pistons. Linkages (the drive rods) couple the pistons to the wheels to produce rotary power. The expanded gas is then released into the atmosphere in the form of steam. The rotation of the wheels propels the engine down the track.

External-combustion rotary engines use rotors and chambers instead of pistons, cylinders, and linkage to more directly convert the expansion of heated gases into rotational movement.

External-combustion turbine engines direct the expansion of heated gases against a turbine, which then rotates. A modern nuclear power plant is an example of an external-combustion closed-loop Rankine-cycle turbine engine. Nuclear fuel is "burned" in a combustion chamber (the reactor) and used to heat water. The water is vaporized to become the desired gas (steam). This gas is directed against a turbine, which then rotates. The expanded steam is then condensed back into water and made available for reheating. The rotation of the turbine drives a generator to produce electricity.

External-combustion engines may be made much more efficient than corresponding internal-combustion engines. Through the use of a combustion chamber, the fuel may be more thoroughly consumed, releasing a significantly greater percentage of the potential energy. More thorough consumption means fewer combustion by-products and a significant reduction in pollutants.

Because external-combustion engines do not themselves encompass the combustion of fuel, they may be engineered to operate at a lower pressure and a lower temperature than comparable internal-combustion engines. This in turn allows the use of less complex support systems (e.g., cooling and exhaust systems), and results in simpler and lighter engines for a give power output.

Typical turbine engines operate at high rotational speeds. This high rotational speed presents several engineering challenges that typically result in specialized designs and materials. This adds to system complexity and cost. Also, in order to operate at low-to-moderate rotational speeds, turbine engines typically utilize a step-down transmission of some sort. This, too, adds to system complexity and cost.

Similarly, reciprocating engines require linkage to convert linear motion to rotary motion. This results in complex designs with many moving parts. In addition, the linear motion of the pistons and the motions of the linkages produce significant vibration. This vibration results in a loss of efficiency and a decrease in engine life. To compensate, components are typically counterbalanced to reduce vibration. This results in an increase in both design complexity and cost.

Typical heat engines depend upon the diabatic expansion of the gas. That is, as the gas expands, it loses heat. This diabatic expansion represents a loss of energy.

What is needed, therefore, is an external-combustion rotary heat engine that maximizes and utilizes the adiabatic expansive energy of the gases.

SUMMARY OF THE INVENTION

Accordingly, it is an advantage of the present invention that a plasma-vortex engine and method of operation therefor are provided.

It is another advantage of the present invention that an external-combustion plasma-vortex engine is provided that utilizes external combustion.

It is another advantage of the present invention that a rotary plasma-vortex engine is provided.

It is another advantage of the present invention that a plasma-vortex engine is provided that utilizes vapor hydraulics.

It is another advantage of the present invention that a plasma-vortex engine is provided that utilizes adiabatic gas expansion.

It is another advantage of the present invention that a plasma-vortex engine is provided that operates at moderate temperatures and pressures.

The above and other advantages of the present invention are carried out in one form by a plasma-vortex engine incorporating a plasmatic fluid configured to become a plasma upon vaporization thereof, a fluid heater configured to heat the plasmatic fluid, an expansion chamber formed of a housing, a first end plate coupled to the housing, and a second end plate coupled to the housing in opposition to the first end plate, a shaft incoincidentally coupled to the expansion chamber, a rotor coaxially coupled to the shaft within the expansion chamber, a plurality of vanes pivotally coupled to either the expansion chamber or the rotor, and a vortex generator coupled to the expansion chamber and configured to generate a plasma vortex within the expansion chamber.

The above and other advantages of the present invention are carried out in one form by a method of operating a plasma-vortex engine, wherein the method includes heating a plasmatic fluid, introducing a plasma derived from the plasmatic fluid into an expansion chamber, expanding the plasma adiabatically, exerting an expansive force upon one of a plurality of vanes within the expansion chamber in response to the expanding activity, rotating one of a rotor and a housing in response to the exerting activity, and exhausting the plasma from the expansion chamber.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
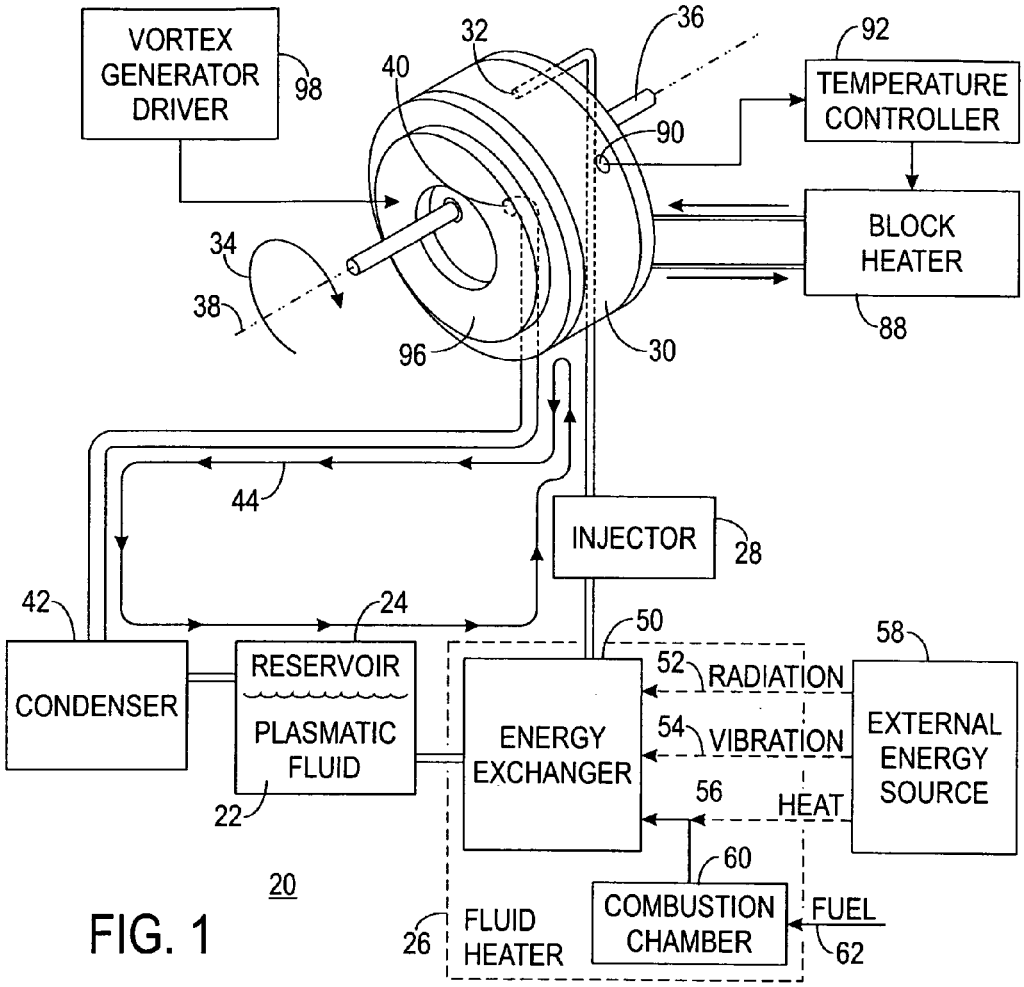
FIG. 1 shows a schematic view of a plasma-vortex engine in accordance with a preferred embodiment of the present invention.

FIG. 1 shows a schematic view of a plasma-vortex engine 20 in accordance with a preferred embodiment of the present invention. The following discussion refers to FIG. 1.

Plasma-vortex engine 20 is desirably configured as a closed-loop external combustion engine, e.g., a Rankine-cycle engine. That is, a plasmatic fluid 22 from a reservoir 24 is heated by a fluid heater 26 to become a plasma (discussed hereinafter). An injector 28 introduces the plasma into an expansion chamber 30 through an inlet port 32. Within expansion chamber 30, vapor hydraulics, adiabatic expansion, and vortical forces (discussed hereinafter) cause rotation 34 of a shaft 36 about a shaft axis 38. The plasma is then exhausted from expansion chamber 30 through an outlet port 40. The exhausted plasma is condensed back into plasmatic FLUID 22 by a condenser 42 and returns to reservoir 24. This process continues as long as engine 20 is operational in a closed loop 44.

Those skilled in the art will appreciate that, in some embodiments, an open-loop system may be desirable. In an open-loop system, condenser 42 is omitted and the exhausted plasma is vented to outside the system (e.g., to the atmosphere). The use of an open-loop embodiment does not depart from the spirit of the present invention.

Figure 2:
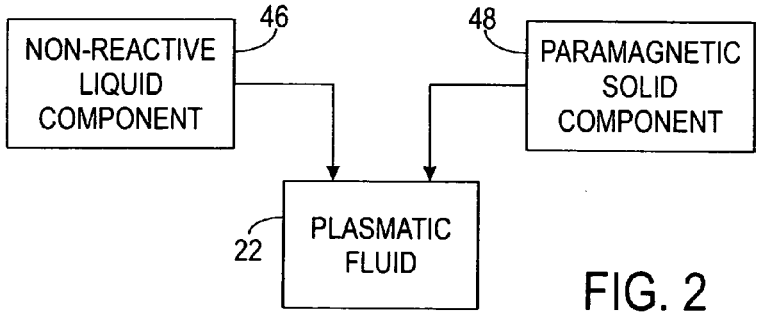
FIG. 2 shows a block diagram of the composition of a plasmatic fluid for the plasma-vortex engine of FIG. 1 in accordance with a preferred embodiment of the present invention.

FIG. 2 shows a block diagram of the composition of a plasmatic fluid for plasma-vortex engine 20 in accordance with a preferred embodiment of the present invention. The following discussion refers to FIGS. 1 and 2.

Plasmatic fluid 22 is composed of a non-reactive liquid component 46 to which has been added a solid component 48. Solid component 48 is particulate and is effectively held in suspension within the liquid component 46. Liquid and solid components 46 and 48 desirably have a low coefficient of vaporization and a high heat transfer characteristic. These properties would make plasmatic fluid 22 suitable for use in a closed-loop engine with moderate operating temperatures, i.e., below 400° C. (750° F.), and at moderate pressures.

Liquid component 46 is desirably a diamagnetic liquid, (e.g., a liquid whose permeability is less than that of a vacuum, and which, when placed in a magnetic field, has an induced magnetism in a direction opposite to that of a ferromagnetic material). One possible such liquid is a non-polluting fluorocarbon, such as Fluoroinert liquid FC-77® produced by 3M.

Solid component 48 is desirably a particulate paramagnetic substance (e.g., a substance and in which the magnetic moments of the atoms are not aligned, and that, when placed in a magnetic field, possesses magnetization in direct proportion to the field strength. One possible such substance is powdered magnetite ($Fe_3O_4$).

Plasmatic fluid 22 may also contain other components, such as an ester-based fuel reformulator and/or a seal lubricant.

Plasmatic fluid 22 desirably consists of a diamagnetic liquid in which a particulate paramagnetic solid is suspended. When plasmatic fluid 22 is vaporized, the resulting vapor will carry a paramagnetic charge, and sustain its ability to be affected by an electromagnetic field. That is, the gaseous form of plasmatic fluid 22 is a plasma.

The following discussion refers to FIG. 1.

Plasmatic fluid 22 is heated to become a plasma by fluid heater 26. More specifically, plasmatic fluid 22 is heated by an energy exchanger 50 within fluid heater 26. Energy exchanger 50 is configured to exchange or convert an input energy into thermal energy, and to heat plasmatic fluid with that thermal energy. The exchange and conversion of energy may be accomplished by electrical, mechanical, or fluidic means without departing from the spirit of the present invention.

The input energy for energy exchanger 50 may be any desired form of energy. For example, preferred input energies may include, but are not limited to, radiation 52 (e.g., solar or nuclear), vibration 54 (e.g., acoustics, cymatics, and sonoluminescence), and heat 56 obtained from an external energy source 58. Heat 56 may be conveyed to energy exchanger 50 by radiation, convection, and/or conduction.

Plasma-vortex engine 20 is an external-combustion engine. This may be taken theoretically to mean simply that the consumption of fuel takes place outside of engine 20. This is the case when the input energy is such that there is no combustion (e.g., solar energy).

Conversely, "external-combustion engine" may be taken literally to mean that there is an external combustion chamber 60 coupled to energy exchanger 50. This is one preferred embodiment of the present invention. In this embodiment, fuel 62 is consumed within combustion chamber 60 by combustion (i.e., fuel 62 is burned). Heat 56 generated by this combustion becomes the input energy for energy exchanger 50.

The combustion-chamber embodiment of the present invention is desirable for use in a multiplicity of applications. In a motor vehicle, for example, fuel 62 may be hydrogen and oxygen, liquefied natural gas, or any common (and desirably non-polluting) inflammable substance. As another example, in a fixed installation of engine 20, fuel 62 may be natural gas, oil, or desulphurized powdered coal. In any case, fuel 62 is burned in combustion chamber 60 and the resultant heat 56 is used to heat plasmatic fluid 22 in energy exchanger 50.

Figure 3:
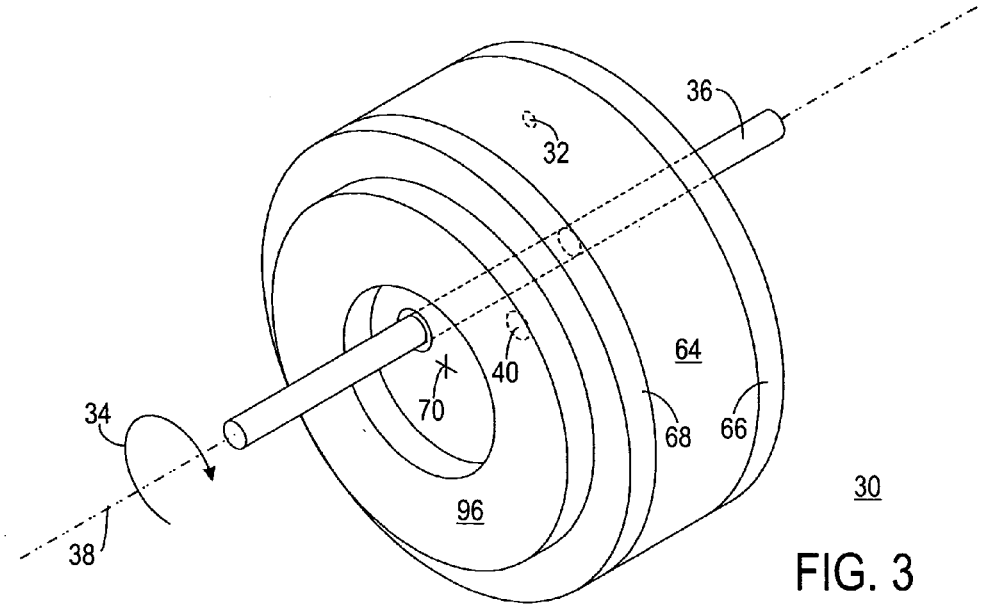
FIG. 3 shows an isometric external view of an expansion chamber for the plasma-vortex engine of FIG. 1 in accordance with a preferred embodiment of the present invention.
Figure 4:
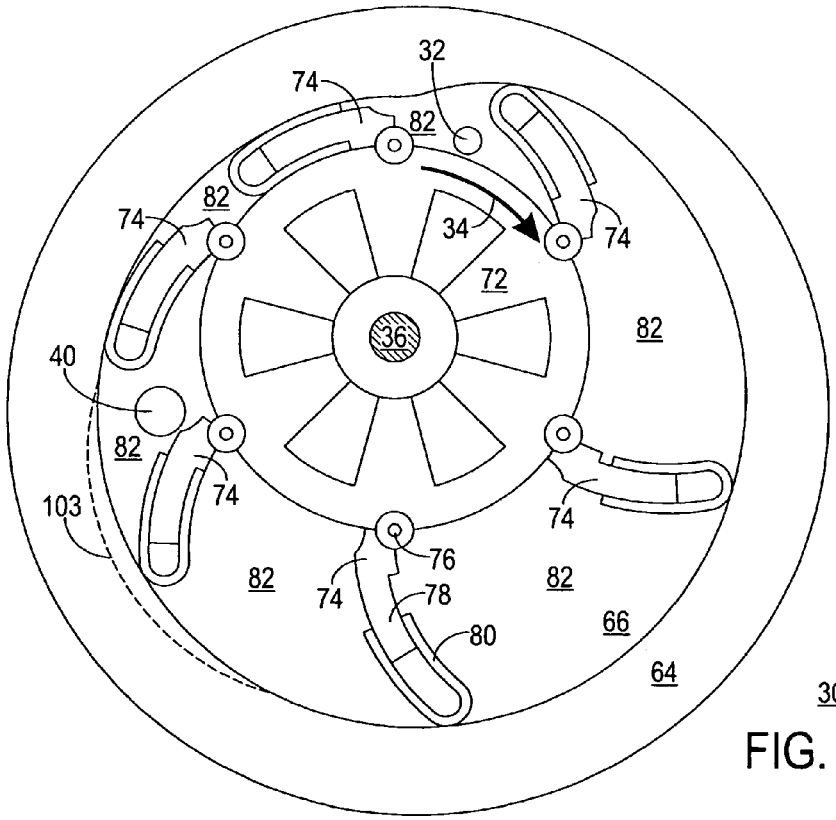
FIG. 4 shows a side view of the expansion chamber of FIG. 3 with pivotal vanes and with one end plate removed in accordance with a preferred embodiment of the present invention.

FIGS. 3 and 4 show an external isometric view and an internal side view, respectively, of expansion chamber 30 in accordance with a preferred embodiment of the present invention. The following discussion refers to FIGS. 1, and 3, and 4.

Expansion chamber 30 is formed of a housing 64, a first end plate 66 affixed to housing 64, and a second end plate 68 affixed to housing 64 in opposition to first end plate 66. FIG. 4 depicts a side view of expansion chamber 30 with second end plate 68 removed.

A shaft 36 is incoincidentally coupled to expansion chamber 30 (i.e., coupled so that an axis 38 of shaft 36 does not pass through a center 70 of expansion chamber 30). As depicted in FIGS. 1 and 3, shaft 36 passes through both of end plates 66 and 68. Those skilled in the art will appreciate that this is not a requirement of the present invention. Shaft 36 may terminate in one end plate 66 or 68 (and pass through the other end plate 68 or 66, respectively) without departing from the spirit of the present invention.

A rotor 72 is encompassed within expansion chamber 30 and coaxially coupled to shaft 36. A plurality of vanes 74 are pivotally coupled to rotor 72, housing 64, or one of end plates 66 or 68. Each of vanes 74 is made up of a vane pivot 76, a vane body 78, and a vane slide 80. Rotor 72 and each of vanes 74 also incorporate seals (not shown). The seals allow rotor 72 and vanes 74 to maintain sufficient sealing contact with end plates 66 and 68, and vanes 74 with either housing 64 or rotor 72, so as to provide adequate containment of the expanding plasma.

In the embodiment of FIG. 4, vanes 74 are pivotally coupled to rotor 72, and rotor 72 is fixedly coupled to shaft 36. When engine 20 is in operation, pressure upon vanes 74 causes rotor 72 to rotate (housing 64 does not rotate). This in turn causes rotation of shaft 36. As rotor 72 rotates, each vane 74 pivots outward to maintain contact with housing 64. At some point, the "contracted" length of vane 74 is insufficient to maintain contact with housing 64. Therefore, vane slide 80 slides over vane body 78 to increase the length of vane 74 and maintain contact.

In an alternative embodiment (not shown in the Figures), vanes 74 are pivotally coupled to housing 64 or one of end plates 66 or 68, and one or both of end plates 66 and 68 is fixedly coupled to shaft 36. When engine 20 is in operation, pressure upon vanes 74 causes housing 64 to rotate. As rotor 72 rotates freely on shaft 36, it functions as a type of gear and guide for vanes 74. As rotor 72 rotates, each vane 74 pivots inward to maintain contact with rotor 72. At some point, the "contracted" length of vane 74 is insufficient to maintain contact. Therefore, vane slide 80 slides over vane body 78 to increase the length of vane 74 and maintain contact.

Those skilled in the art will appreciate that whether rotor 72 or housing 64 rotates is moot. For the purposes of this discussion, it will be assumed that shaft 36 is fixedly coupled to rotor 72. The use of alternative embodiments does not depart from the spirit of the present invention.

Figure 5:
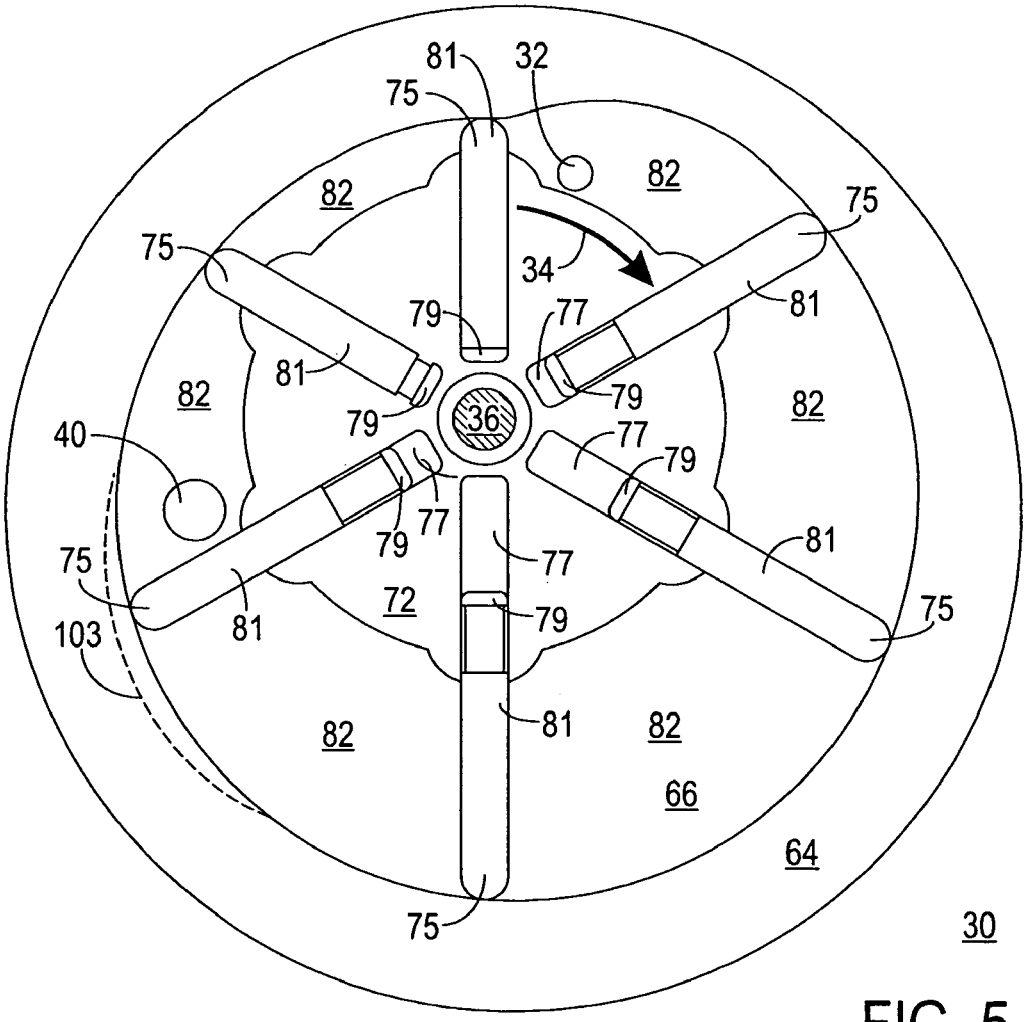
FIG. 5 shows a side view of the expansion chamber of FIG. 3 with sliding vanes and with one end plate removed in accordance with a preferred embodiment of the present invention.

FIG. 5 shows a side view of an alternative embodiment of expansion chamber 30 with sliding vanes 75 and with one end plate 66 or 68 removed in accordance with a preferred embodiment of the present invention. The following discussing refers to FIGS. 1 and 5.

A rotor 72 is encompassed within expansion chamber 30 and coaxially coupled to shaft 36. Rotor 72 has a plurality of vane channels 77. Within each vane channel 77 is located a vane 75. Vanes 75 are slidingly coupled to rotor 72 through vane channel 77. That is, each vane 75 is configured to slide within vane channel 77. Each of vanes 75 is made up of a vane base 79 and a vane extension 81. Each of vanes 75 also incorporates seals (not shown). The seals allow vanes 75 to maintain a sufficiently sealed contact with housing 64 and end plates 66 and 68.

In the embodiment of FIG. 5, vanes 75 are slidingly coupled to rotor 72, and rotor 72 is fixedly coupled to shaft 36. When engine 20 is in operation, pressure upon vanes 75 causes rotor 72 to rotate (housing 64 does not rotate). This in turn causes rotation of shaft 36. As rotor 72 rotates, each vane 75 slides outward to maintain contact with housing 64. At some point, the "contracted" length of vane 75 is insufficient to maintain contact with housing 64. Therefore, vane extension 81 slides over vane base 79 to increase the length of vane 75 and maintain contact.

For the purposes of this discussion, it will be assumed that the embodiment of FIG. 4, i.e., having vanes 74 pivotally coupled to rotor 72, and shaft 36 fixedly coupled to rotor 72.

Figure 6:
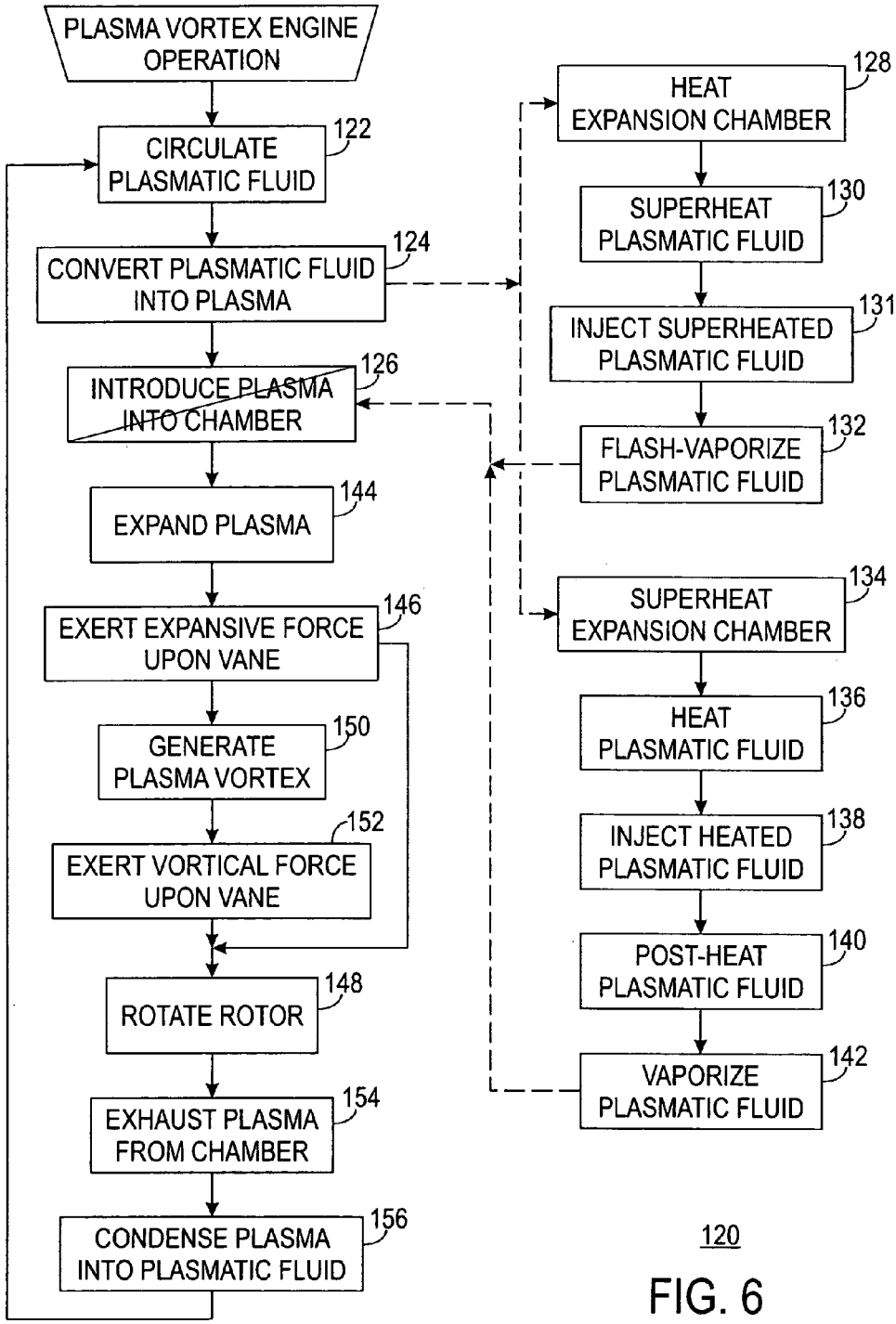
FIG. 6 shows a flow chart of a process for operation of the plasma-vortex engine of FIG. 1 in accordance with a preferred embodiment of the present invention.

FIG. 6 shows a flow chart of a process 120 for the operation of plasma-vortex engine 20 in accordance with a preferred embodiment of the present invention. FIGS. 7, 8, 9, 10, 11, and 12 show side views of expansion chamber 30 (with one end plate removed) during operation, and depicting a plurality of cells 82 within expansion chamber 30 with a reference cell 821 at a 1 o'clock position (FIG. 7), a 3 o'clock position (FIG. 8), a 5 o'clock position (FIG. 9), a 7 o'clock position (FIG. 10), a 9 o'clock position (FIG. 11), and an 11 o'clock position (FIG. 12) in accordance with a preferred embodiment of the present invention. The following discussion refers to FIGS. 1, 2, 3, 6, 7, 8, 9, 10, 11, and 12.

Process 120 describes the operation of plasma-vortex engine 20. Throughout operation process 120, a parent task 122 circulates plasmatic fluid 22 around closed loop 44. During a portion of closed loop 44, plasmatic fluid 22 exists as a plasma 86.

Plasmatic fluid 22 passes from reservoir 24 to fluid heater 26. In a task 124, fluid heater 26 converts plasmatic fluid 22 into plasma 86. In a task 126 (FIG. 7), plasma 86 is introduced to expansion chamber 30.

Tasks 124 and 126 are intertwined and work together in one of two different scenarios.

In the first scenario, in a task 128, a block heater 88 heats expansion chamber 30 to a desired operating temperature. One or more sensors 90 detect the temperature of expansion chamber 30 and couple to a temperature controller 92, which in turn causes block heater 88 to maintain expansion chamber 30 at the desired temperature throughout operation process 120. Those skilled in the art will appreciate that block heater 88 may be a heat extractor configured to utilize excess heat from fluid heater 26 to heat expansion chamber 30.

In a task 130, fluid heater 26 superheats plasmatic fluid 22. That is, fluid heater 26 heats plasmatic fluid 22 to a temperature greater than or equal to a vapor-point temperature of plasmatic fluid 22.

In a task 131, injector 28 injects plasmatic fluid 22 into a cell 82 of expansion chamber 30 through inlet port 32. Because plasmatic fluid 22 is superheated, plasmatic fluid 22 flash-vaporizes to become plasma 86 in a task 132 substantially simultaneously with injection task 122.

In the second scenario, in a task 134, block heater 88 heats expansion chamber 30 to an operating temperature in excess of the vapor-point temperature of plasmatic fluid 22. Expansion chamber 30 is maintained at this temperature throughout operation process 120 by the action of sensor(s) 90, temperature controller 92, and block heater 88.

In a task 136, fluid heater 26 heats plasmatic fluid 22 to a temperature proximate but less than the vapor-point temperature of plasmatic fluid 22.

In a task 138, injector 28 injects plasmatic fluid 22 into a cell 82 of expansion chamber 30 through inlet port 32. Because expansion chamber 30 has a temperature in excess of the vapor-point temperature of plasmatic fluid 22, injection into cell 82 causes plasmatic fluid 22 to be post-heated to the temperature of expansion chamber 30 in a task 140. This in turn causes plasmatic fluid 22 to vaporize and become plasma 86 in a task 142.

In either scenario, plasma 86 now resides within a cell 82 of expansion chamber 30. For the purposes of this discussion, this specific cell 82 shall be referred to as reference cell 821. Reference cell 821 exists at the 1 o'clock position (i.e., from vane pivot 76 at the 12 o'clock position to vane pivot 76 at the 2 o'clock position) in FIG. 7, and rotates clockwise through the 3 o'clock, 5 o'clock, 7 o'clock, 9 o'clock, and 11 o'clock positions in FIGS. 8, 9, 10, 11, and 12, respectively.

When plasma 86 is introduced into reference cell 821 (FIG. 7), plasma 86 begins to expand hydraulically and adiabatically in a task 144. This begins the power cycle of engine 20. In a task 146 the hydraulic and adiabatic expansion of plasma 22 exerts an expansive force 94 upon a leading vane 741 (i.e., upon that vane 74 bordering reference cell 821 in the direction of rotation 34). This causes, in a task 148, leading vane 741 to move in the direction of rotation 34. This in turn results in the rotation 34 of rotor 72 and shaft 36.

In a task 150, a vortex generator 96, driven by a vortex generator driver 98, generates a vortex 100 (FIGS. 8, 9, and 10) in plasma 86 within reference cell 821. In a task 150, vortex 100 exerts a vortical force 102 upon leading vane 741. Vortical force 102 adds to expansive force 94 and contributes to rotation 34 of rotor 72 and shaft 36 (task 148).

Figure 7:
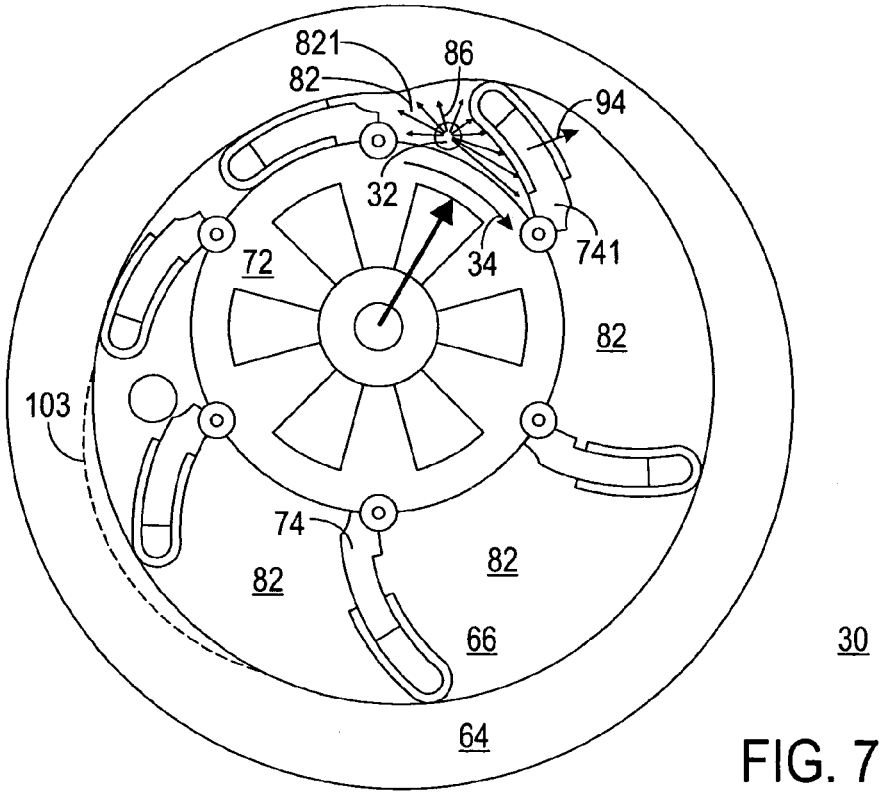
FIG. 7 shows a side view of the expansion chamber of FIG. 1 (with one end plate removed) during operation with a reference cell at a 1 o'clock position in accordance with a preferred embodiment of the present invention.
Figure 8:
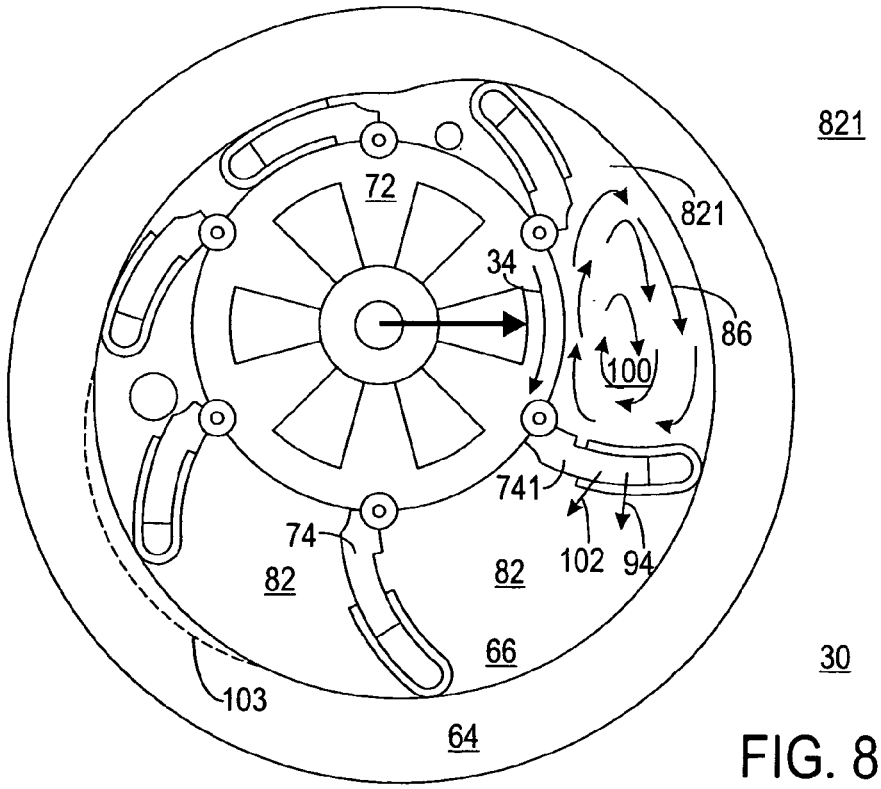
FIG. 8 shows a side view of the expansion chamber of FIG. 7 (with one end plate removed) during operation with the reference cell at a 3 o'clock position in accordance with a preferred embodiment of the present invention.
Figure 9:
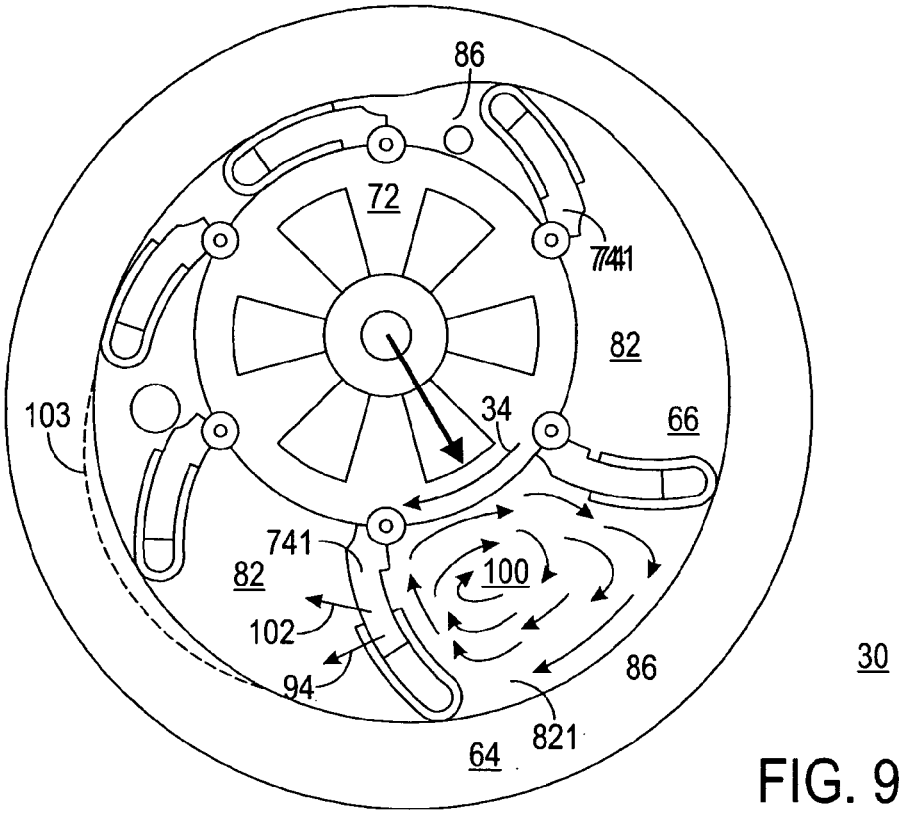
FIG. 9 shows a side view of the expansion chamber of FIG. 7 (with one end plate removed) during operation with the reference cell at a 5 o'clock position in accordance with a preferred embodiment of the present invention.

It may be observed from FIGS. 7, 8, and 9 that the preferred curvature of housing 64 is such that when reference cell 821 is in approximately the 1 o'clock position until when reference cell 821 is in approximately the 6 o'clock position, reference cell 821 increases in volume. This constitutes the power stroke of engine 20. This increase in volume allows energy to be obtained from the combination of vapor hydraulics and adiabatic expansion, i.e., from expansive and vortical forces 102 and 40. In order that a maximum use of energy may be obtained, it is desirable that the curvature of housing 64 relative to rotor 72 be such that the volume of space within reference cell 821 increase in the golden ratio $\phi$. The golden ratio is defined as a ratio where the lesser is to the greater as the greater is to the sum of the lesser plus the greater:

$$\frac{a}{b} = \frac{b}{a+b}.$$

Assuming the lesser, a, to be unity, then the greater, b, becomes $\phi$:

$$\frac{1}{\phi} = \frac{\phi}{1+\phi}:$$

$$\phi^2=\phi+1:$$

$$\phi^2-\phi-1=0.$$

Using the quadratic formula (limited to the positive result):

$$\phi = \frac{1+\sqrt{5}}{2} \cong 1.618033989 \ldots$$

Those skilled in the art will recognize this as the Fibonacci ratio. It will also be recognized from the theory of gases that adiabatic expansion can be maintained to a very high ratio, providing there is a relatively constant temperature (hence, the heating of expansion chamber 30 by block heater 88 (FIG. 1), and a relatively constant pressure provided by the seals of vanes 74 and rotor 72. Therefore, to extract the maximum energy from adiabatic expansion, the volume of reference cell 821 should increase according to the Fibonacci ratio. This is accomplished by the curvature of housing 64 in conjunction with the offset of rotor 72 within housing 64.

Figure 10:
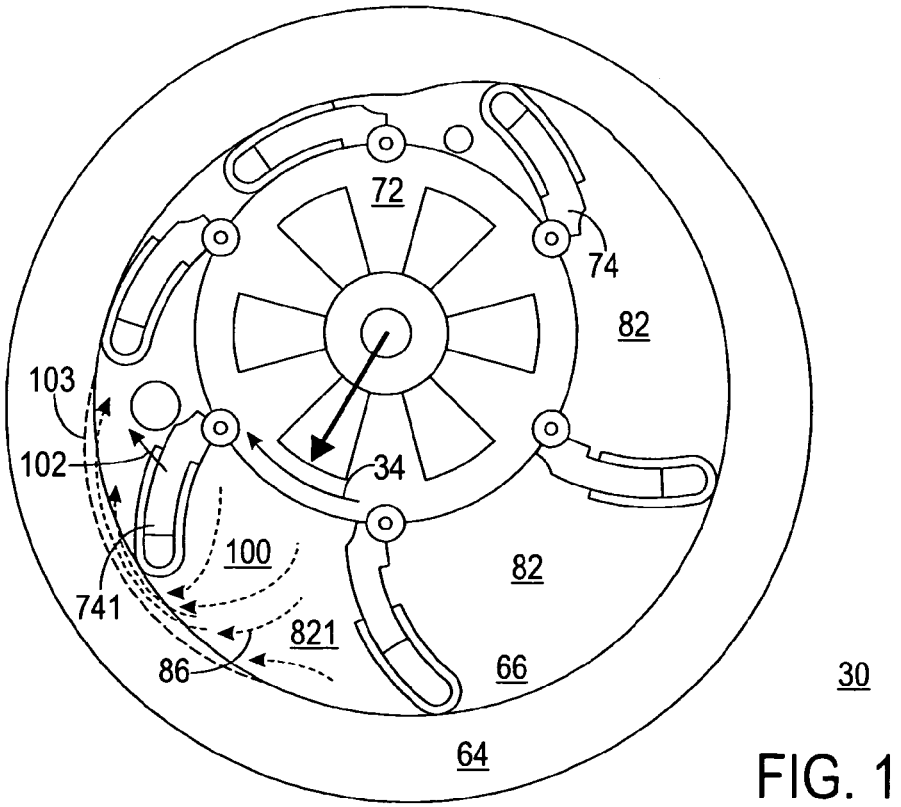
FIG. 10 shows a side view of the expansion chamber of FIG. 7 (with one end plate removed) during operation with the reference cell at a 7 o'clock position in accordance with a preferred embodiment of the present invention.
Figure 11:
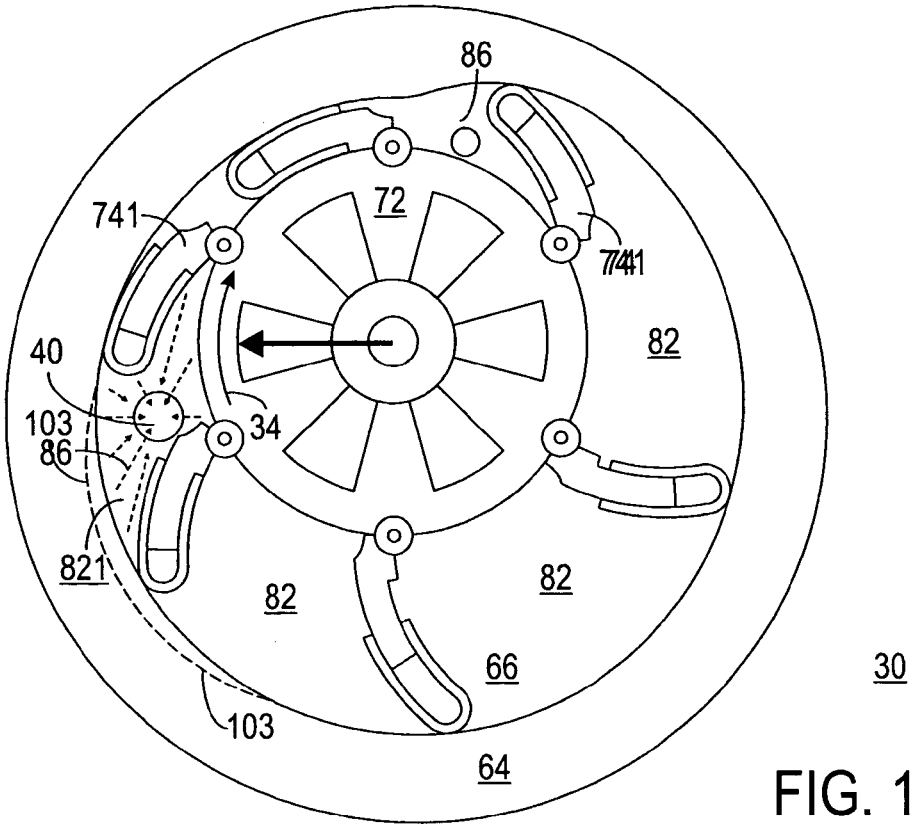
FIG. 11 shows a side view of the expansion chamber of FIG. 7 (with one end plate removed) during operation with the reference cell at a 9 o'clock position in accordance with a preferred embodiment of the present invention.
Figure 12:
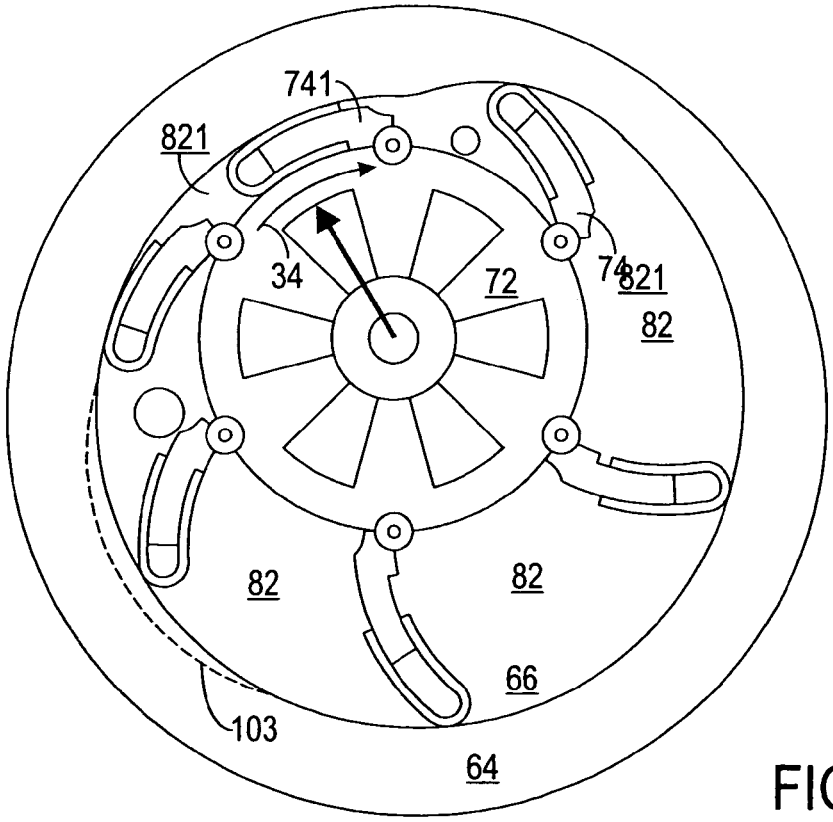
FIG. 12 shows a side view of the expansion chamber of FIG. 7 (with one end plate removed) during operation with the reference cell at an 11 o'clock position in accordance with a preferred embodiment of the present invention.

Tasks 144 and 152, i.e., the adiabatic expansion of plasma 86 and the generation of vortex 100, continue throughout the power cycle of engine 20. Once the power cycle is complete, at nominally the 6 o'clock position, reference cell 821 decreases in volume as rotation 34 continues. In a task 154, plasma 86 is then exhausted from reference cell 821 through exhaust grooves 103 cut into the inside of expansion chamber 30 and/or endplates 66 and/or 68 (not shown), and thence through outlet port 40 (FIGS. 10 and 11). In a task 156, the exhausted plasma 86 is condensed by condenser 42 to become plasmatic fluid 22 and returns to reservoir 24. Rotation 34 continues until reference cell 821 is again at the 1 o'clock position.

Those skilled in the art will appreciate that the hereinbefore-discussed cycle of reference cell 821 (FIGS. 7, 8, 9, 10, 11, and 12) is representative of only one cell 74. As depicted in the Figures, expansion chamber has six cells 74. As each cell 74 reaches the 1 o'clock position (FIG. 7), that cell 74 becomes reference cell 821 and proceeds through the discussed tasks. Therefore, at any given time during operation process 120, every cell 74 between the 1 o'clock position (FIG. 7) and the 9 o'clock position (FIG. 11), inclusively, contains plasma 86 and is represented by reference cell 821 at some portion of its cycle.

Figure 13:
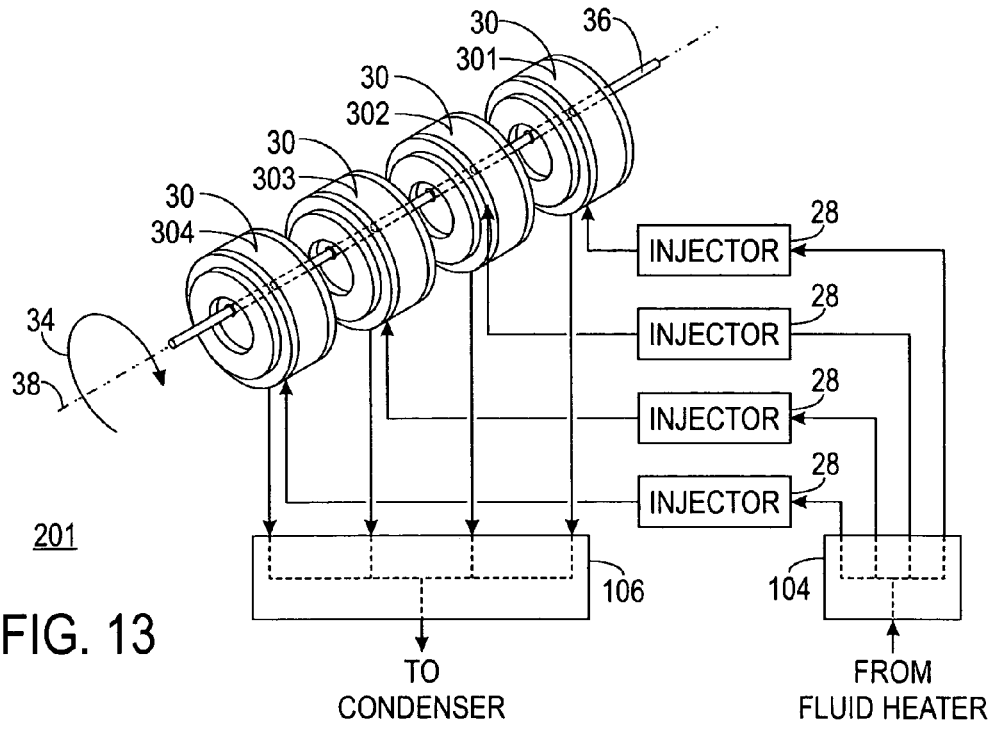
FIG. 13 shows a schematic view of a multi-chamber plasma-vortex engine in accordance with a preferred embodiment of the present invention.
Figure 14:
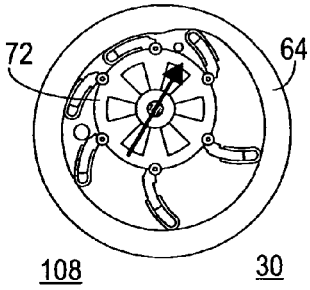
FIG. 14 shows an interior side view of an expansion chamber for the plasma-vortex engine of FIG. 13 in a 1 o'clock state in accordance with a preferred embodiment of the present invention.
Figure 15:
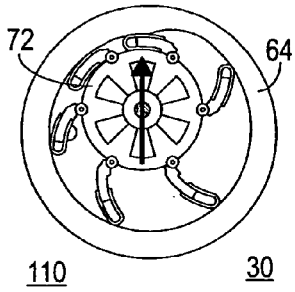
FIG. 15 shows an interior side view of an expansion chamber for the plasma-vortex engine of FIG. 13 in a 12 o'clock state in accordance with a preferred embodiment of the present invention.
Figure 16:
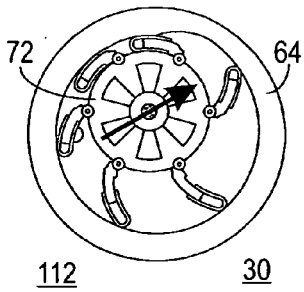
FIG. 16 shows an interior side view of an expansion chamber for the plasma-vortex engine of FIG. 13 in a 2 o'clock state in accordance with a preferred embodiment of the present invention.

FIG. 13 shows a schematic view of a four-chamber plasma-vortex engine 201 in accordance with a preferred embodiment of the present invention. FIGS. 14, 15, and 16 show interior side views of expansion chambers 30 for plasma-vortex engine 201 in a 1 o'clock state 108 (FIG. 14), a 12 o'clock state 110 (FIG. 15), and a 2 o'clock state 112 (FIG. 16) in accordance with a preferred embodiment of the present invention. The following discussion refers to FIGS. 1, 2, 3, 13, 14, 15, and 16.

In the four-chamber engine of FIG. 13, there are four substantially identical expansion chambers 30 coupled to a common shaft 36. In order to differentiate the four expansion chambers 30, they are labeled 301, 302, 303, and 304.

Each of the four expansion chambers 301, 302, 303, and 304 is injected with plasmatic fluid 22 through a separate injector 28. Injectors 28 are fed from an intake manifold 104, which is in turn fed from fluid heater 26 (FIG. 1).

The output of each of expansion chambers 301, 302, 303, and 304 passes to an exhaust manifold 106, and then to condenser 42 (FIG. 1) for condensation and reuse.

Rotors 72 are coupled to shaft 36 in a specific pattern. The rotors 72 within expansion chambers 302 and 304 are displaced approximately 30° from the rotors 72 within expansion chambers 301 and 303.

When expansion chamber 301 has a cell 74 in a first state 108 (FIG. 14), i.e., the 1 o'clock position and ready to receive plasmatic fluid 22, then expansion chamber 302 has a cell 74 in a second state 110 (FIG. 15), i.e., the 12 o'clock position, approximately 30° in advance of the first state 108 (FIG. 13). When the cell 74 in expansion chamber 301 has advanced to a third state 112 (FIG. 16), i.e., the 2 o'clock position, approximately 30° past the first state 108, then the cell 74 in expansion chamber 302 has advanced to the first state 108 (FIG. 14) and is ready to receive plasmatic fluid 22. Expansion chambers 303 and 304 operate as do expansion chambers 301 and 302, respectively.

There are four expansion chambers 30, and each of the four expansion chambers 30 has six cells 74. Therefore, displacing the rotors 72 of expansion chambers 302 and 304 by 30° relative to the rotors 72 of expansion chambers 301 and 303 allows for smooth operation with plasmatic fluid 22 being injected into two of expansion chambers 30 approximate every 30° of rotation.

In an alternative embodiment (not shown), even smoother operation may be obtained by displacing the rotor 72 of expansion chambers 302 by approximately 15° relative to the rotor 72 of expansion chamber 301, displacing the rotor 72 of expansion chambers 303 by approximately 15° relative to the rotor 72 of expansion chamber 302, and by displacing the rotor 72 of expansion chamber 304 by approximately 15° relative to the rotor 72 of expansion chamber 303. This allows for operation with plasmatic fluid 22 being injected into two of expansion chambers 30 approximately every 15° of rotation.

Figure 18:
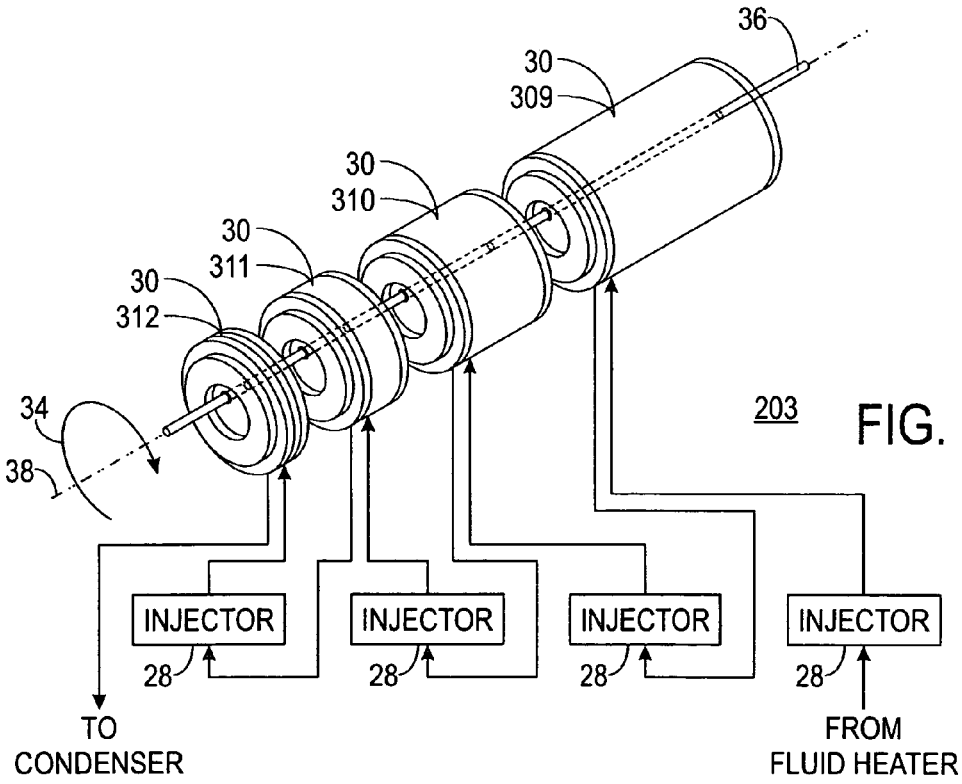
FIG. 18 shows a schematic view of a cascading plasma-vortex engine with variant chamber depths in accordance with a preferred embodiment of the present invention.
Figure 17:
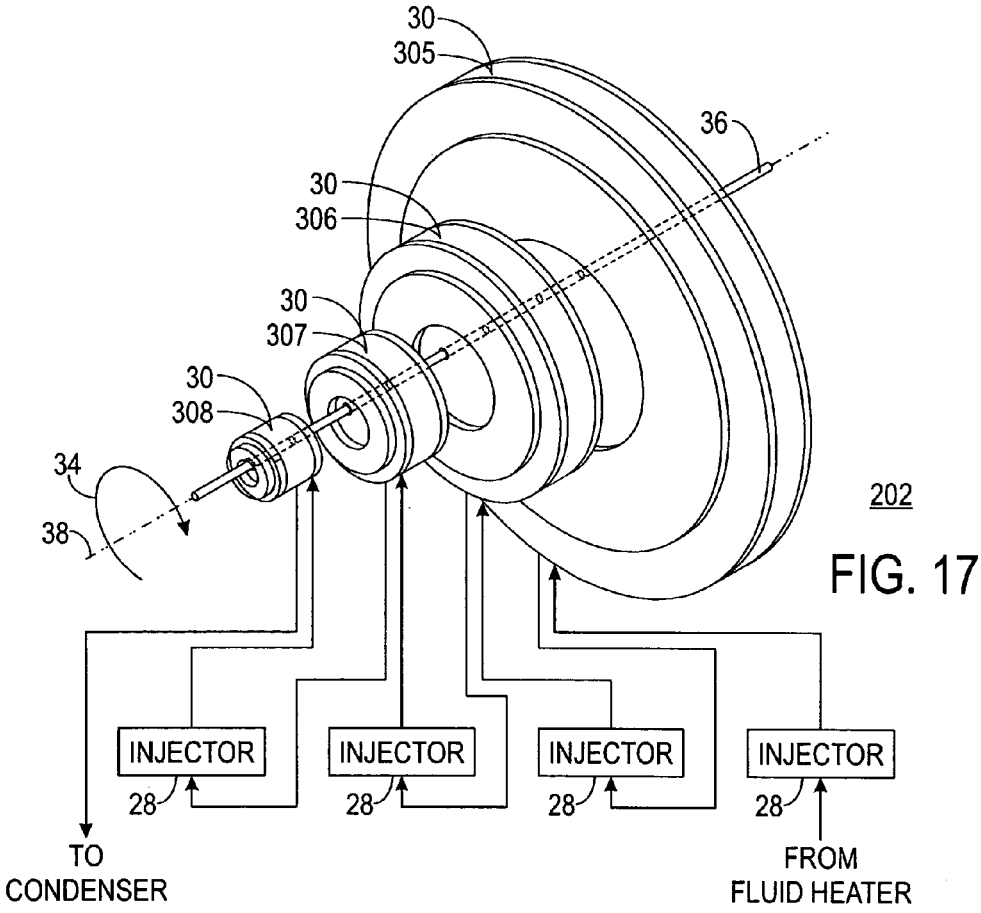
FIG. 17 shows a schematic view of a cascading plasma-vortex engine with variant chamber diameters in accordance with a preferred embodiment of the present invention.

FIGS. 17 and 18 show schematic views of cascading plasma-vortex engines 202 and 203 with variant chamber diameters (FIG. 17) and variant chamber depths (FIG. 18) in accordance with preferred embodiments of the present invention. The following discussion refers to FIGS. 1, 2, 3, 13, 14, 15, 16, 17, and 18.

The cascading four-chamber engine 202 of FIG. 17 is substantially identical to the four-chamber engine 201 of FIG. 13 (discussed hereinbefore) except for the diameters of the expansion chambers 30 and the path of plasma 86. In order to differentiate the four expansion chambers 30 of engine 202, they are labeled 305, 306, 307, and 308.

Similarly, the cascading four-chamber engine 203 of FIG. 18 is substantially identical to the cascading four-chamber engine 202 of FIG. 17 except for the depths of the expansion chambers 30. In order to differentiate the four expansion chambers 30 of engine 203, they are labeled 309, 310, 311, and 312.

In engine 202, all expansion chambers 30 have substantially the same depth. The volume of each expansion chamber 30 is therefor a function of the diameter of that expansion chamber 30. Conversely, in engine 203, all expansion chambers 30 have substantially the same diameter. The volume of each expansion chamber 30 is therefor a function of the depth of that expansion chamber 30.

The following discussion assumes an exemplary embodiment of engine 202 or 203 wherein each expansion chamber extracts approximately 70 percent of the potential energy from plasma 86. Plasma 86 is first passed from fluid heater 26 (FIG. 1) and injected into first expansion chamber 305 or 309. Expansion chamber 305 or 309 has a predetermined volume. Experimentation has shown that the exhausted plasma 86 from expansion chamber 305 or 309 has lost approximately 70 percent of its initial potential adiabatic energy.

The exhausted plasma 86 from expansion chamber 305 or 309 is then injected into expansion chamber 306 or 310. Expansion chamber 306 or 310 has substantially one-fourth the volume of expansion chamber 305 or 309. The exhausted plasma 86 from expansion chamber 306 or 310 has again lost approximately 70 percent of its potential adiabatic energy, or approximately 91 percent of its original potential adiabatic energy.

The exhausted plasma 86 from expansion chamber 306 or 310 is then injected into expansion chamber 307 or 311. Expansion chamber 307 or 311 has substantially one-fourth the volume of expansion chamber 306 or 310 (i.e., substantially one sixteenth that of expansion chamber 305 or 309). The exhausted plasma 86 from expansion chamber 306 or 310 has again lost approximately 70 percent of its potential adiabatic energy, or approximately 97 percent of its original potential adiabatic energy.

The exhausted plasma 86 from expansion chamber 307 or 311 is then injected into expansion chamber 308 or 312. Expansion chamber 308 or 312 has substantially one-fourth the volume of expansion chamber 307 or 311 (i.e., substantially one thirty-second that of expansion chamber 305 or 309). The exhausted plasma 86 from expansion chamber 307 or 311 has again lost approximately 70 percent of its potential adiabatic energy, or approximately 99 percent of its original potential adiabatic energy.

This very exhausted plasma 86 is then passed to condenser 42 (FIG. 1) to be condensed and recirculated.

In this manner, cascading plasma-vortex engines 202 and 203 derive a maximal amount of energy from plasmatic fluid 22.

Those skilled in the art will appreciate that the four-chamber embodiments of FIGS. 13, 17, and 18 discussed hereinbefore are exemplary only. The use of multi-chamber embodiments having other than four expansion chambers 30 (i.e., six chambers) does not depart from the spirit of the present invention.

In summary, the present invention teaches a plasma-vortex engine 20 and method of operation 120 therefor. Plasma-vortex engine 20 is a rotary engine utilizing external combustion. Plasma-vortex engine 20 also utilizes adiabatic gas expansion at moderate temperatures and pressures.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A plasma-vortex engine comprising:

a plasmatic fluid configured to become a plasma upon vaporization thereof;

a fluid heater configured to heat said plasmatic fluid;

an expansion chamber comprising:

a housing;

a first end plate affixed to said housing; and a second end plate affixed to said housing in opposition to said first end plate;

a shaft incoincidentally coupled to said expansion chamber;

a rotor coaxially coupled to said shaft within said expansion chamber;

a plurality of vanes coupled to one of:

said rotor;

said housing; and one of said first and second end plates; and a vortex generator coupled to said expansion chamber and configured to generate a plasma vortex within said expansion chamber.

2. An engine as claimed in claim 1 wherein:

said fluid heater heats said plasmatic fluid;

said engine additionally comprises an inlet port though which said plasma is introduced to said expansion chamber, wherein said plasmatic fluid is vaporized into said plasma prior to or during said introduction;

said plasma expands adiabatically within said expansion chamber and exerts an expansive force against one of said plurality of vanes;

said vortex generator generates said plasma vortex within said plasma;

said plasma vortex exerts a vortical force against said one vane;

one of said rotor and said housing rotates in response to said expansive and vortical forces; and said engine additionally comprises an outlet port through which said plasma is exhausted from said expansion chamber.

3. An engine as claimed in claim 1 additionally comprising a condenser coupled between said outlet port and an inlet to said fluid heater, and configured to condense said plasma into said plasmatic fluid.

4. An engine as claimed in claim 1 wherein said fluid heater comprises an external-combustion chamber configured to heat said plasmatic fluid through the combustion of a fuel.

5. An engine as claimed in claim 1 wherein said fluid heater comprises an energy exchanger configured to heat said plasmatic fluid through the transfer of energy from an external energy source.

6. An engine as claimed in claim 5 wherein said external energy source utilizes energy in the form of heat, radiation, and vibration.

7. An engine as claimed in claim 1 wherein said plasmatic fluid comprises:

a non-reactive liquid component; and a paramagnetic solid component.

8. An engine as claimed in claim 7 wherein said non-reactive liquid component is diamagnetic.

9. An engine as claimed in claim 7 wherein said paramagnetic solid component is particulate.

10. An engine as claimed in claim 1 wherein each of said plurality of vanes is pivotally coupled to one of:

said rotor;

said housing; and one of said first and second end plates.

11. An engine as claimed in claim 1 wherein each of said plurality of vanes is slidingly coupled to said rotor.

12. A method of operating a plasma-vortex engine, said method comprising:

heating a plasmatic fluid;

introducing a plasma derived from said plasmatic fluid into an expansion chamber;

expanding said plasma adiabatically;

exerting an expansive force upon one of a plurality of vanes within said expansion chamber in response to said expanding activity;

rotating one of a rotor and a housing in response to said exerting activity; and exhausting said plasma from said expansion chamber.

13. A method as claimed in claim 12 wherein:

said method additionally comprises:

generating a vortex within said plasma within said expansion chamber; and applying a vortical force upon said one vane in response to said generating activity; and said rotating activity rotates said one of said rotor and said housing in response to said exerting and applying activities.

14. A method as claimed in claim 12 wherein:

said heating activity heats said plasmatic fluid to a temperature greater than or equal to a vapor point of said plasmatic fluid; and said introducing activity comprises:

vaporizing said plasmatic fluid to form said plasma in response to said heating activity; and injecting said plasma into said expansion chamber.

15. A method as claimed in claim 12 wherein:

said heating activity heats said plasmatic fluid to a temperature less than and proximate a vapor point of said plasmatic fluid; and said introducing activity comprises:

injecting said plasmatic fluid into said expansion chamber; and vaporizing said plasmatic fluid to form said plasma in response to said injecting activity.

16. A method as claimed in claim 12 additionally comprising:

circulating said plasmatic fluid in a closed loop between said engine and a fluid heater configured to effect said heating activity; and converting said plasmatic fluid to said plasma in response to said heating activity for at least a portion of said closed loop.

17. A method as claimed in claim 12 additionally comprising condensing said plasma into said plasmatic fluid within said closed loop.

18. A method as claimed in claim 12 wherein:

said method additionally comprises transferring energy into said plasmatic fluid from an external energy source;

said heating activity heats said plasmatic fluid in response to said transferring activity.

19. A method as claimed in claim 18 wherein said external energy source is one of heat, radiation, and vibration.

20. A method as claimed in claim 12 additionally comprising:

forming said expansion chamber from said housing, a first end plate, and a second end plate;

encompassing a rotor within said expansion chamber;

incoincidentally coupling a shaft to said expansion chamber;

coaxially coupling said shaft to said rotor; and pivotally coupling said plurality of vanes to one of:

said rotor;

said housing; and one of said first and second end plates.

21. A plasma-vortex engine comprising:

a plasmatic fluid configured to become a plasma upon vaporization thereof;

a fluid heater configured to heat said plasmatic fluid;

a plurality of expansion chambers, wherein each of said expansion chambers comprises:

a housing;

a first end plate coupled to said housing; and a second end plate coupled to said housing in opposition to said first end plate;

a shaft incoincidentally coupled to each of said plurality of expansion chambers;

a plurality of rotors coaxially coupled to said shaft, wherein each of said rotors is encompassed within one of said expansion chambers;

a plurality of vanes, wherein for each of said expansion chambers a plural portion of said plurality of vanes is coupled to one of:

said rotor;

said housing; and one of said first and second end plates; and a vortex generator configured to generate a vortex within each of said expansion chambers.

22. An engine as claimed in claim 21 wherein:

said fluid heater heats said plasmatic fluid;

said plasma is introduced to a first expansion chamber when said first expansion chamber is in a first state and a second expansion chamber is in a second state in advance of said first state, wherein said plasmatic fluid is vaporized into said plasma prior to or during said introduction;

said plasma exerts a force against one of said plurality of vanes within said first expansion chamber;

said shaft rotates in response to said force, thereby causing said first expansion chamber to shift from said first state to a third state in arrears of said first state, and causing said second expansion chamber to shift from said second state to said first state;

said plasma is introduced to said second expansion chamber, wherein said plasmatic fluid is vaporized into said plasma prior to or during said introduction;

said plasma exerts a force against one of said plurality of vanes within said second expansion chamber; and said shaft rotates in response to said force, thereby causing said second expansion chamber to shift from said first state to said third state.

23. An engine as claimed in claim 21 wherein:

said fluid heater heats said plasmatic fluid to produce said plasma;

said plasma from said fluid heater is introduced to a first expansion chamber having a first volume, wherein said plasma is expanded within and exhausted by said first expansion chamber;

said plasma from said first expansion chamber is introduced to a second expansion chamber having a second volume, wherein said second volume is less than said first volume, and wherein said plasma is expanded within and exhausted by said second expansion chamber;

said plasma from said second expansion chamber is introduced to a third expansion chamber having a third volume, wherein said third volume is less than said second volume, and wherein said plasma is expanded within and exhausted by said third expansion chamber; and said plasma from said third expansion chamber is introduced to a fourth expansion chamber having a fourth volume, wherein said fourth volume is less than said third volume, and wherein said plasma is expanded within and exhausted by said fourth expansion chamber.

* * * * *